US006374707B1

(12) United States Patent
Browning

(10) Patent No.: US 6,374,707 B1
(45) Date of Patent: Apr. 23, 2002

(54) EYE BOLT WRENCH

(76) Inventor: Steven F. Browning, 13 Sunnymead Dr., Gulfport, MS (US) 39503

( * ) Notice: Subject to any disclaimer, the term of this patent is extended or adjusted under 35 U.S.C. 154(b) by 0 days.

(21) Appl. No.: 09/429,654

(22) Filed: Oct. 29, 1999

(51) Int. Cl.[7] ..... B25B 13/02
(52) U.S. Cl. ..... 81/119; 81/901
(58) Field of Search ..... 81/119, 121.1, 81/125, 124.2, 486, 901

(56) References Cited

U.S. PATENT DOCUMENTS 985,087 A * 2/1911 Wilson ..... 81/121.1
4,115,474 A * 9/1978 Vassiliades et al. ..... 525/58
4,894,269 A * 1/1990 Kimura ..... 428/43
5,439,338 A * 8/1995 Rosenberg ..... 411/400

OTHER PUBLICATIONS

Wolfcraft Hook Driver, Date unknown.

* cited by examiner

*Primary Examiner*—Joseph J. Hail, III
*Assistant Examiner*—David B. Thomas

(57) ABSTRACT

A wrench for driving an eye bolt comprising a shaft and a cup, the cup including a cavity that snugly receives the eye portion of an eye bolt for driving said eye bolt.

8 Claims, 1 Drawing Sheet

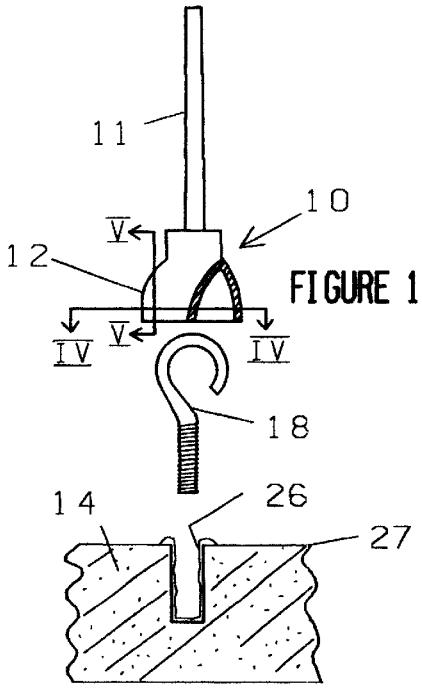
FIGURE 1
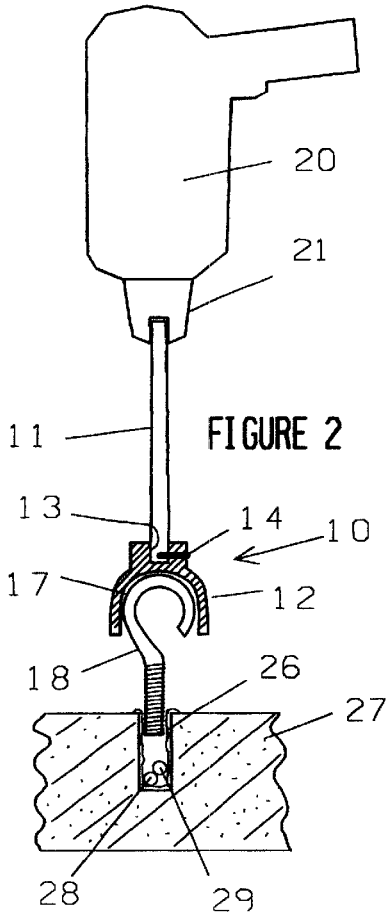
FIGURE 2
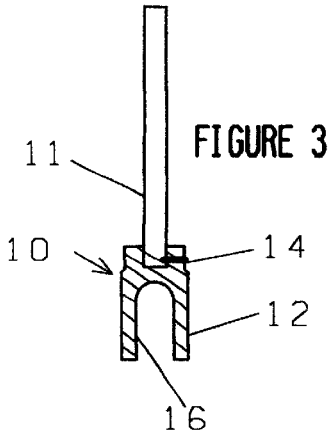
FIGURE 3
FIGURE 4
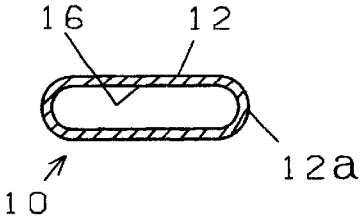
FIGURE 5
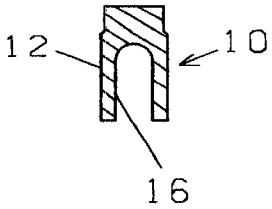

EYE BOLT WRENCH

FIELD OF THE INVENTION

Present invention relates to wrenches and more particularly to wrenches that are driven by a power unit.

BACKGROUND OF THE INVENTION

Wrenches have been used for many years in driving bolts and nuts in a variety of mechanical applications. For more than a hundred years wrenches have been available for example in hexagonal shapes. Early wrenches were formed by bending of sheet metal into a hexagonal shape. These wrenches were driven by an integral lever.

Wrenches have been improved over the past century and are now available in a wide variety of types. The types include socket wrenches, open end wrenches, box wrenches, Crescent wrenches, pipe wrenches and a wide variety of others. In the early part of the century, wrenches were hand driven. In other words, the wrench included a handle portion to be grasped by the user's hands. The user's hand rotates the handle around the portion of the wrench which grips the bolt, screw or the like. The longer the wrench handle, the greater the power that is applied to the bolt.

Later developments of the wrench found power driving mechanism. Early in this development the power driver was an electrical drill power unit in which a socket was mounted. Later pneumatic and hydraulic power drivers were developed for driving the wrench. Screw drivers followed a similar development pattern. Early screwdrivers were hand driven. More recently power driven screwdrivers and bit attachments have been developed.

Eye bolts provide a unique situation since they are not easily grasped by a wrench. Historically, eye bolts have been driven by insertion of a short bar through the eye of the bolt. The bar is then moved to rotate the eye bolt until the eye bolt is secured in place. Any of a variety of short bars have been used in the past. For example, the shaft of a screwdriver was often used as the bar. Use of a bar for rotating the eye bolt is slow and clumsy. This is not a serious problem if a very limited number of eye bolts are being secured in place in a given application. However it becomes slow, tedious, and particularly clumsy if a large number of eye bolts are inserted in place. There has long been a need for a wrench adapted for use with eye bolts.

The present invention overcomes this long standing problem by providing a wrench that is adapted for use with an eye bolt. The present eye bolt wrench may be used to insert a large number of eye bolts in place using any of various conventional power driving devices such as electrical screwdrivers, electrical drills, pneumatic rotational drivers, hydraulic rotational drivers and the like.

SUMMARY OF THE INVENTION

The present invention relates to the wrench for engaging eye bolts. The term eye bolts refers to a support mechanism that includes a threaded shaft and integral loop. The threaded shaft may be frustaconically shaped, e.g., the shaft decreases in diameter terminating in a point. Alternatively, the eye bolt may include a threaded shaft that is of a constant diameter. The eye bolt may be screwed into a cavity such as a cavity in a concrete wall. The eye bolt may create its own cavity as the eye bolt is screwed into a structure, such as screwed into a piece of lumber.

The present wrench includes a shaft and a cup. The shaft may be releasibly engaged with the cup such that the shaft is rotationally locked with respect to the cup and yet disengageable when one wishes to use a different sized cup with the shaft. Alternatively, the shaft and cup may be integral, e.g., cast as one piece. The cup may define an elongated cavity. In other words, the cavity may be semicircular in vertical cross section from one plan view. The cavity may be of a narrower semicircular shape in a cross sectional view from a ninety degree plan view. This creates a cavity adapted for reception of a portion of the eye portion of the eye bolt. The wrench may be driven by an electrically powered screwdriver or any other suitable rotational driving device such as a hydraulic driver or pneumatic driver.

DESCRIPTION OF THE DRAWINGS

In the drawings:

FIG. 1 is a vertical plan view of the wrench of the present invention with a portion broken away, an eye bolt and a structure into which the eye bolt is to be inserted;

FIG. 2 is a similar vertical plan view showing the present invention mounted in a powered driving device with an eye bolt secured within the wrench ready for insertion of the eye bolt into the support structure;

FIG. 3 is a side view of the wrench of the present invention with a portion broken away to show underlying structure.

FIG. 4 is a sectional view taken along the line IV—IV in FIG. 1; and

FIG. 5 is a sectional view taken along the line V—V in FIG. 1.

DETAILED DESCRIPTION OF THE INVENTION

The eye bolt wrench 10 of the present invention, FIGS. 1–5 includes a shaft 11 and an eye bolt cup 12. The shaft 11 and cup 12 may be constructed of tempered steel. The shaft 11 may have a hexagonal shape that engages in the opening 13 defined in the cup 12. Mechanism may be provided to releasably lock the shaft to the cup. For example, a ball detent 14 of conventional design may be used.

The size of wrench 10, of course, will be dependent upon the size of the eye bolt 18 which is to be driven. The cup 12 includes walls 12*a* that define a cavity 17 that is oval in horizontal cross section as shown in FIG. 4. The cavity 17 is semi-circular in vertical cross section as shown in FIGS. 2 and 5. The dimensions of the cavity 16 are such as to snugly but releasably receive the eye of the bolt 18. The cavity 16 may be deep enough to readily support the eye bolt 18 during the driving of the eye bolt 18.

The shaft 11 is large enough to provide the strength necessary to drive the eye bolt 18. The shaft 11 may be of any desired length. The shaft 11 may be uniform in shape and dimensions throughout its length, e.g. hexagonal in shape. Alternatively, the shaft may have a hexagonal end portion that engages the opening 13 and circular portion that engages the device which drives the tool 10.

USE OF THE INVENTION

The tool 10 may be used by assembling the shaft 11 and the cup 12 by insertion of the shaft 11 into the opening 13 with the shaft being suitably locked in place. The tool 10 may be mounted in a driving device such as a pneumatic power driver 20. The shaft is locked with respect to the bit 21 for the power driving. An eye bolt 18 is inserted in the cup 12 with the eye portion of the eye bolt 18 resting within the cavity 17. The eye bolt 16 may be driven into an opening

26 in the structure 27 such as a concrete wall. In some instances the threaded portion of the eye bolt may create the opening 26 during the driving of the eye bolt 18 by the driver 20. In other instances an opening will be pre-drilled in the structure 27.

PREFERRED EMBODIMENT OF THE INVENTION

A preferred embodiment of the present invention includes use of the tool 10 in the driving and mixing of a catalyzed polymer or copolymer. In the preferred embodiment an opening 26 is first drilled in the structure 27. The opening is of a size, e.g., diameter and depth, that will readily receive the threaded portion of the eye bolt 18. A pair of capsules 28 and 29 are inserted into the opening. One of the capsules may be contained within the other capsule. One of the capsules contains a monomer. The other capsule contains a catalyst. The eye bolt 16 is then inserted into the opening 26 and driven by the tool 10 which is mounted in the driver 20. The driver 20 may rotatably drive the eye bolt 18 which simultaneously breaks open the capsules 28, 29 mixing their contents together. Alternatively, the driver 20 may oscillate the eye bolt 18 such that the eye bolt 18 is driven first in one direction and then in the other direction until the monomer and catalyst are thoroughly mixed. The catalyst causes the monomer to polymerize and set into a strong bond between the eye bolt 18 and the structure 27.

What is claimed is:

1. An eye bolt wrench system comprising:

means for mounting an eye bolt in a concrete structure, said mounting means comprising:

means for drilling a cavity in said concrete structure of a diameter and depth to receive a portion of an eye bolt;

means for inserting a capsule containing a monomer into said drilled cavity;

means for inserting a capsule containing a catalyst suitable for polymerizing said monomer into said drilled cavity;

means for engaging an eye bolt in said eye bolt wrench including a cavity for receipt of the eye of an eye bolt wrench;

power means for driving said eye bolt wrench to break said capsules, mix said monomer and catalyst and drive the shaft portion of said eye bolt into said drilled cavity.

2. The eye bolt wrench system of claim 1 wherein said power means includes driver means to rotatably drive said eye bolt first in one direction and then in an opposite direction to thoroughly mix said monomer and catalyst.

3. The eye bolt wrench system of claim 2 wherein said driving means includes pneumatically powered drive means.

4. The eye bolt wrench system of claim 3 wherein said driving means includes hydraulically powered drive means.

5. An eye bolt wrench system comprising:

means for mounting an eye bolt in a concrete structure having a drilled cavity, said mounting means including:

means for inserting a capsule containing a monomer into said drilled cavity;

means for inserting a capsule containing a catalyst suitable for polymerizing said monomer into said drilled cavity;

an eye bolt wrench;

means for engaging an eye bolt in said eye bolt wrench including a cavity for receipt of the eye of an eye bolt wrench;

power means for driving said eye bolt wrench to break said capsules, mix said monomer and catalyst and drive the shaft portion of said eye bolt into said drilled cavity.

6. The eye bolt wrench system of claim 5 wherein said power means includes driver means to rotatably drive said eye bolt first in one direction and then in an opposite direction to thoroughly mix said monomer and catalyst.

7. The eye bolt wrench system of claim 6 wherein said driver means includes pneumatically powered drive means.

8. The eye bolt wrench system of claim 7 wherein said driver means includes hydraulically powered drive means.

* * * * *